US012601285B2

(12) United States Patent
Umeno

(10) Patent No.: US 12,601,285 B2
(45) Date of Patent: Apr. 14, 2026

(54) INTERNAL COMBUSTION ENGINE AND PURIFICATION DEVICE

(71) Applicant: FUTABA INDUSTRIAL CO., LTD., Okazaki (JP)

(72) Inventor: Yasufumi Umeno, Okazaki (JP)

(73) Assignee: FUTABA INDUSTRIAL CO., LTD., Okazaki (JP)

( * ) Notice: Subject to any disclaimer, the term of this patent is extended or adjusted under 35 U.S.C. 154(b) by 0 days.

(21) Appl. No.: 18/930,207

(22) Filed: Oct. 29, 2024

(65) Prior Publication Data

US 2025/0154893 A1 May 15, 2025

(30) Foreign Application Priority Data

Nov. 15, 2023 (JP) ..... 2023-194440

(51) Int. Cl.
*F01N 3/10* (2006.01)
*F01P 3/12* (2006.01)

(52) U.S. Cl.
CPC . *F01N 3/10* (2013.01); *F01P 3/12* (2013.01)

(58) Field of Classification Search
CPC ... F01N 3/10; F01N 3/101; F01N 3/02; F01N 3/04; F01N 3/043; F01N 3/28; F01N 13/001; F01N 2250/10; F01N 2260/02; F01N 2260/024; F01P 3/12
See application file for complete search history.

(56) References Cited

U.S. PATENT DOCUMENTS 5,212,949 A * 5/1993 Shiozawa ..... F01N 13/004 440/89 C
5,239,825 A * 8/1993 Shibata ..... F01N 3/046 440/89 C
5,899,063 A * 5/1999 Leistritz ..... F01N 3/046 422/173
5,911,608 A * 6/1999 Nakayama ..... F01N 3/2882 440/89 R (Continued)

FOREIGN PATENT DOCUMENTS

JP 2001207839 A 8/2001
JP 2012241523 A 12/2012

(Continued)

OTHER PUBLICATIONS

Notice of Reasons for Refusal for Japanese Patent Application No. 2023-194440 mailed Oct. 7, 2025, 6 pages.

*Primary Examiner* — Grant Moubry
*Assistant Examiner* — James G Moubry
(74) *Attorney, Agent, or Firm* — Withrow + Terranova, PLLC; Vincent K. Gustafson

(57) ABSTRACT

An internal combustion engine includes at least one combustion chamber, a main body, at least one purification device, and a cooler. The main body includes therein the at least one combustion chamber, and an exhaust flow path configured to allow exhaust gas flowing out of the at least one combustion chamber to flow down. The at least one purification device is arranged in the exhaust flow path of the main body. The cooler is configured to cool the at least one purification device. Each of the at least one purification device includes a purification member and a case. The purification member is configured to purify the exhaust gas. The case contains the purification member.

14 Claims, 2 Drawing Sheets

(56) References Cited

U.S. PATENT DOCUMENTS

| | | | | |
|---|---|---|---|---|
| 8,038,493 | B1 * | 10/2011 | Broman | B63H 21/32 440/88 HE |
| 12,158,091 | B2 * | 12/2024 | Kono | B63H 20/28 |
| 2003/0155108 | A1 | 8/2003 | Shinohara et al. | |
| 2012/0291761 | A1 | 11/2012 | Iizuka et al. | |
| 2016/0221658 | A1 | 8/2016 | Achiwa et al. | |
| 2022/0235725 | A1 * | 7/2022 | Brand | F01N 3/2882 |

FOREIGN PATENT DOCUMENTS

| | | | | |
|---|---|---|---|---|
| JP | 2016142202 | A | 8/2016 | |
| WO | WO-2022195896 | A1 * | 9/2022 | F01N 13/08 |

* cited by examiner

INTERNAL COMBUSTION ENGINE AND PURIFICATION DEVICE

CROSS-REFERENCE TO RELATED APPLICATIONS

This application claims the benefit of Japanese Patent Application No. 2023-194440 filed on Nov. 15, 2023 with the Japan Patent Office, the entire disclosure of which is incorporated herein by reference.

BACKGROUND

The present disclosure relates to an internal combustion engine, and a purification device for purifying exhaust gas.

A technique is known for purifying exhaust gas from an internal combustion engine of a vehicle by a purification device with a catalyst. If the purification device as such is arranged away from the internal combustion engine, it takes longer to reach a temperature at which the catalyst becomes active at the time of starting the internal combustion engine. Thus, immediately after the start of the internal combustion engine, there is a possibility that exhaust purification performance by the purification device may not be fully achieved, and it may become difficult to cope with recent tougher exhaust gas regulations. To address this, a technique is known for arranging a catalyst section at an exhaust port of a combustion chamber of an internal combustion engine, as described in Japanese Unexamined Patent Application Publication No. 2012-241523.

SUMMARY

However, in the technique disclosed in Japanese Unexamined Patent Application Publication No. 2012-241523, the catalyst section is located near the combustion chamber of the internal combustion engine, and thus the catalyst section continues to be exposed to high temperature exhaust gas during the operation of the internal combustion engine. As a result, catalyst metal supported on the catalyst aggregates, and the purification performance of the catalyst section may be degraded.

In one aspect of the present disclosure, it is desirable to reduce degradation of purification performance of an exhaust gas purification device.

One aspect of the present disclosure provides an internal combustion engine of a vehicle, comprising: at least one combustion chamber, a main body, at least one purification device, and a cooler. The main body includes therein the at least one combustion chamber and an exhaust flow path configured to allow exhaust gas flowing out of the at least one combustion chamber to flow down. The at least one purification device is arranged in the exhaust flow path of the main body. The cooler is configured to cool the at least one purification device. Each of the at least one purification device includes a purification member and a case. The purification member is configured to purify the exhaust gas. The case contains the purification member.

With the above-described configuration, the at least one purification device is cooled by the cooler although being arranged in the exhaust flow path provided in the main body of the internal combustion engine. Thus, it is possible to reduce degradation of purification performance of the purification device.

In one aspect of the present disclosure, two or more combustion chambers may be provided as the at least one combustion chamber. One purification device may be provided as the at least one purification device. As the exhaust flow path, two or more first flow paths, each coupled to a corresponding one of the combustion chambers, and a second flow path formed by combining these first flow paths into one may be provided. The purification device may be arranged in the second flow path.

With the above-described configuration, the exhaust gas from the combustion chambers can be efficiently purified.

In one aspect of the present disclosure, two or more combustion chambers may be provided as the at least one combustion chamber. Two or more purification devices may be provided as the at least one purification device. As the exhaust flow path, two or more first flow paths, each extending from a corresponding one of the combustion chambers, may be provided. Each of the purification devices may be arranged in a corresponding one of the first flow paths.

With the above-described configuration, the purification devices can be arranged inside the internal combustion engine.

In one aspect of the present disclosure, the exhaust flow path may have at least one exhaust outlet configured to allow the exhaust gas to flow out of the main body. Each of the at least one purification device may be arranged in the exhaust flow path with a portion of the case protruding from a corresponding one of the at least one exhaust outlet to an outside of the main body.

With the above-described configuration, it is possible to appropriately arrange the purification device in the exhaust flow path.

In one aspect of the present disclosure, the purification member of the at least one purification device may be located inside the main body.

With the above-described configuration, it is possible to appropriately arrange the purification member in the exhaust flow path.

In one aspect of the present disclosure, the cooler may have a flow path for a refrigerant for cooling the internal combustion engine.

With the above-described configuration, it is possible to reduce complexity in configuration caused by addition of the cooler.

In one aspect of the present disclosure, the cooler may have a flow path for a refrigerant for cooling devices mounted on the vehicle other than the internal combustion engine.

With the above-described configuration, it is possible to efficiently cool the purification device.

In one aspect of the present disclosure, the cooler may be arranged to face a portion of the case adjacent to the purification member.

With the above-described configuration, it is possible to appropriately cool the purification member.

One aspect of the present disclosure provides a purification device, which is provided in the above-described internal combustion engine. The purification device includes a purification member configured to purify the exhaust gas, and a case that contains the purification member.

With the above-described configuration, it is possible to reduce degradation of purification performance of the purification device.

BRIEF DESCRIPTION OF THE DRAWINGS

An example embodiment of the present disclosure will be described hereinafter with reference to the accompanying drawings, in which.

DETAILED DESCRIPTION OF EXEMPLARY EMBODIMENTS

1. First Embodiment

(1) Configuration of Internal Combustion Engine

Figure 1:
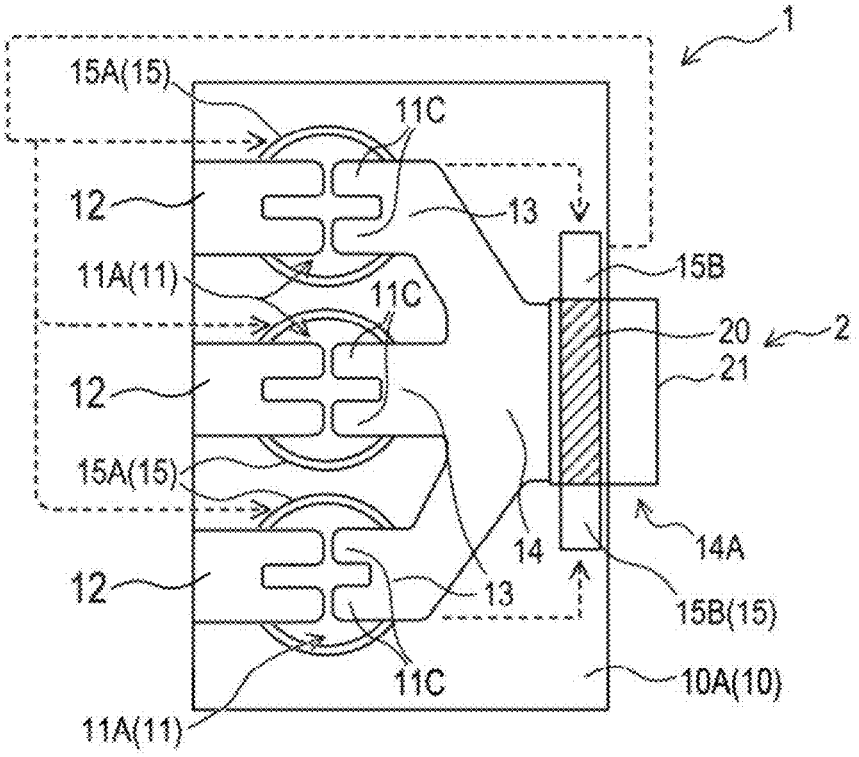
FIG. 1 is an explanatory diagram transparently showing a configuration around combustion chambers, when an internal combustion engine of a first embodiment is viewed from above.
Figure 2:
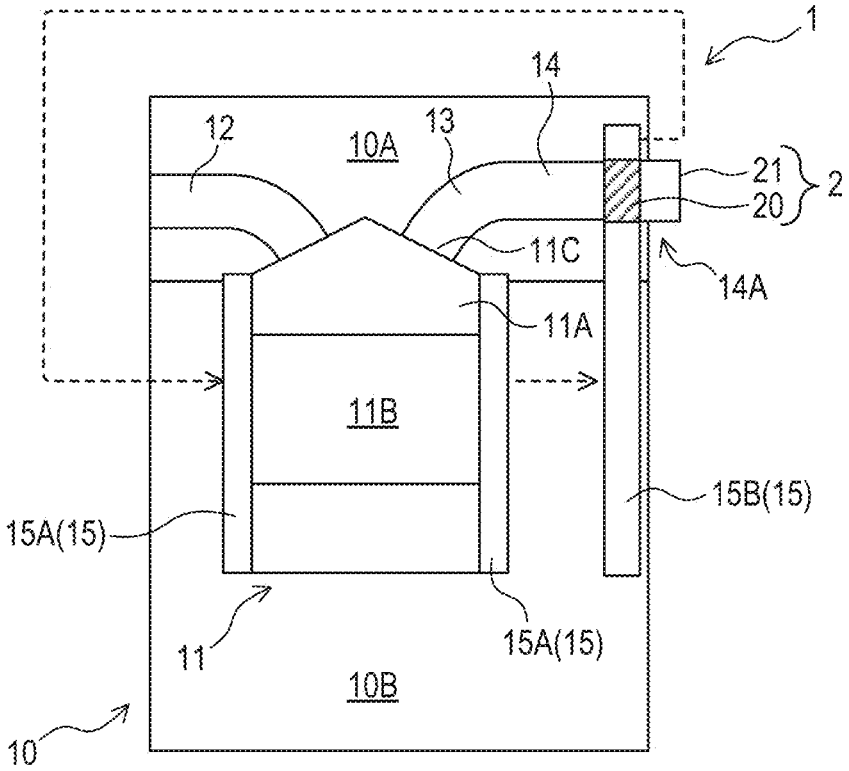
FIG. 2 is an explanatory diagram transparently showing a configuration around a combustion chamber, when the internal combustion engine of the first embodiment is viewed from its side.

An internal combustion engine 1 of the first embodiment is mounted on a vehicle, and serves as a power source for driving a vehicle (see FIGS. 1 and 2). The vehicle includes various automobiles such as two-wheeled vehicles and four-wheeled vehicles. The internal combustion engine 1 can have various configurations such as, for example, a gasoline engine, a diesel engine, a two-stroke engine, a four-stroke engine, and a rotary engine. The internal combustion engine 1 comprises a main body 10, two or more cylinders 11, two or more intake ports 12, two or more exhaust ports 13, a gathering section 14, and a refrigerant flow path 15. As an example, the number of the cylinders 11 is set to three, but this can be determined as appropriate. For example, the number may be one or more than three.

Figure 3:
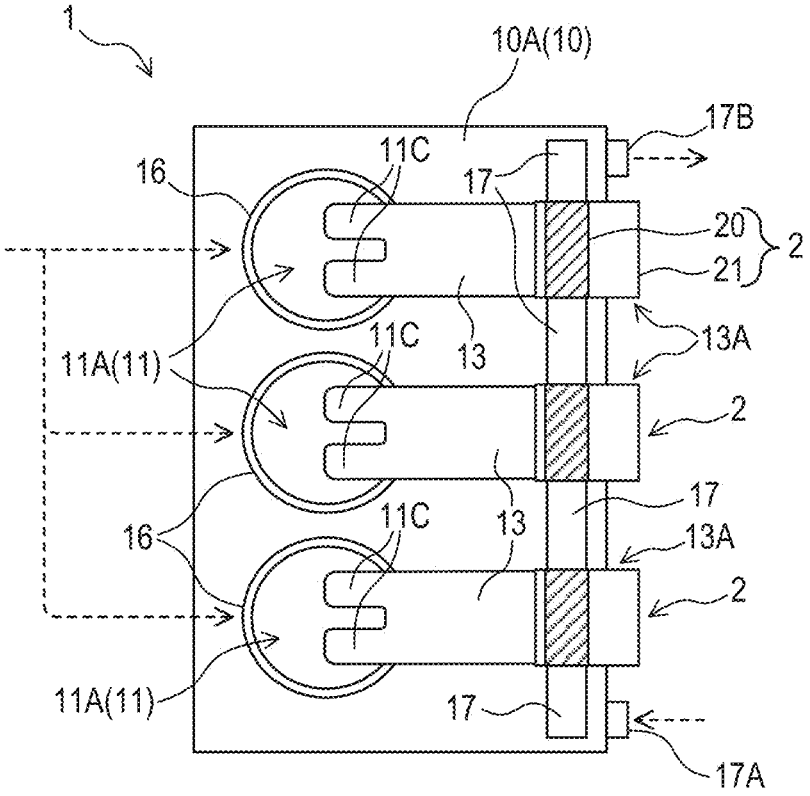
FIG. 3 is an explanatory diagram transparently showing a configuration around combustion chambers, when an internal combustion engine of a second embodiment is viewed from above.

As an example, the internal combustion engine 1 of the first embodiment is configured as a reciprocating engine as shown in FIGS. 1 to 3. The main body 10 includes a cylinder head 10A and a cylinder block 10B. The cylinder block 10B includes the cylinders 11 therein, and contains a crankshaft, and so on. The cylinder head 10A is arranged above the cylinder block 10B, and forms the top of each of the cylinders 11.

Each cylinder 11 has a cylindrical space including a piston 11B arranged therein. In each cylinder 11, a combustion chamber 11A is formed between an upper end of the piston 11B and the cylinder head 10A. In the combustion chamber 11A of each cylinder 11, two exhaust gas valves 11C and two intake valves (not shown) are provided as an example. Of course, the number of the exhaust gas valves 11C and the intake valves provided in each combustion chamber 11A is not limited to this and can be determined as appropriate.

Each of the intake ports 12 is provided inside the cylinder head 10A in correspondence with each cylinder 11, and allows air supplied from a not shown intake manifold to flow into the combustion chamber 11A of the cylinder 11.

Each of the exhaust ports 13 is an exhaust flow path provided inside the cylinder head 10A in correspondence with each cylinder 11, and is coupled to the combustion chamber 11A via the two exhaust gas valves 11C provided in the cylinder 11. The exhaust port 13 is configured to flow down the exhaust gas flowing from each combustion chamber 11A via the exhaust gas valves 11C.

The gathering section 14 is an exhaust flow path formed by combining the two or more exhaust ports 13 into one, and is provided inside the cylinder head 10A. Exhaust gas from each exhaust port 13 flows into the exhaust gas gathering section 14. In other words, a first end of the gathering section 14 is coupled to an end of each exhaust port 13, and the exhaust ports 13 and the gathering section 14 form an exhaust flow path similar to an exhaust gas manifold. On the other hand, a second end of the gathering section 14 forms an exhaust outlet 14A provided on a side surface of the cylinder head 10A, and the exhaust gas that has flown down through the gathering section 14 flows from the exhaust outlet 14A to an outside of the internal combustion engine 1 (in other words, outside of the main body 10). A not shown pipe is coupled to the exhaust outlet 14A. The exhaust gas that has flown out from the exhaust outlet 14A is guided to an outside of the vehicle through the pipe.

The refrigerant flow path 15 is a flow path of a coolant for cooling the internal combustion engine 1, and is formed inside the cylinder head 10A and the cylinder block 10B. The refrigerant flow path 15 includes a water jacket 15A for cooling each cylinder 11, and, as an example, the water jacket 15A is arranged to surround a side surface of each cylinder 11.

(2) Configuration of Purification Device

A purification device 2 configured to purify the exhaust gas is arranged in the gathering section 14 of the internal combustion engine 1 (see FIGS. 1 and 2). The purification device 2 includes a purification member 20 and a case 21.

The purification member 20 is a member configured to purify the exhaust gas, and may be a catalyst, as an example. More specifically, the purification member 20, for example, may have a configuration in which a catalyst substance such as platinum is supported on a carrier such as porous ceramics.

The case 21 is configured to contain the purification member 20. As an example, the case 21 has a tubular shape (as an example, a cylindrical shape), and has first and second openings at opposite ends. Configuration of the case 21 is not limited to this. For example, the case 21 may be a member with multiple holes that communicate between inside and outside of the case 21.

As an example, the purification device 2 is arranged in the gathering section 14 so that a portion of the case 21 is located inside the gathering section 14, and the remaining portion protrudes outside from the exhaust outlet 14A of the cylinder head 10A. Specifically, the purification device 2 covers the exhaust outlet 14A, and the portion thereof is arranged so as to protrude from the gathering section 14. Of course, arrangement of the purification device 2 is not limited to this. The purification device 2 may be arranged so that the entire case 21 is located inside the gathering section 14, and may be arranged away from the exhaust outlet 14A inside the gathering section 14.

When the exhaust gas that has flown into the gathering section 14 reaches the purification member 20, the exhaust gas enters inside of the case 21 via holes formed in the case 21, and is purified by the purification member 20. The purified exhaust gas then flows outside the case 21 via the holes, and further flows downstream.

The portion of the case 21 protrudes from the gathering section 14 to the outside of the internal combustion engine 1. As an example, a position of the purification member 20 inside the case 21 is adjusted so that the purification member 20 is located inside the gathering section 14. Specifically, the purification member 20 is located inside the gathering section 14, in other words, inside the internal combustion engine 1 (in other words, inside the main body 10). Of course, the position of the purification member 20 inside the case 21 is not limited to this, and can be adjusted as appropriate.

(3) Configuration of Refrigerant Flow Path

A portion of the segment of the refrigerant flow path 15 is configured as a cooler 15B for cooling the purification device 2. Specifically, the cooler 15B is arranged near a segment (hereinafter, a placement segment) of the gathering section 14 where the purification device 2 is arranged (see FIGS. 1 and 2).

As an example, the cooler 15B is located on an outer side of the gathering section 14, and is arranged to surround an outer peripheral surface of the placement segment. In other words, the cooler 15B is arranged to face a portion of the case 21 adjacent to the purification member 20. Also, the cooler 15B is arranged to surround the purification member 20. Of course, arrangement of the cooler 15B is not limited to this. The cooler 15B may be arranged inside the gathering section 14. Further, the cooler 15B may be arranged inside the gathering section 14 so as to contact the case 21 of the purification device 2.

Specifically, the purification device 2 is cooled by the coolant for cooling the internal combustion engine 1. The coolant is circulated through the refrigerant flow path 15 by a not shown water pump provided in the cylinder block 10B. The purification device 2 is cooled when the coolant cooled by a not shown radiator reaches the cooler 15B.

2. Second Embodiment (1) Overview

The internal combustion engine 1 of the second embodiment differs from the first embodiment mainly in the configurations of the refrigerant flow path and the exhaust flow path and the number of the purification devices 2 mounted on the vehicle (see FIG. 3). Hereinafter, differences in the internal combustion engine 1 between the second embodiment and the first embodiment will be explained.

(2) Configuration of Exhaust Flow Path

The internal combustion engine 1 of the second embodiment differs from that of the first embodiment in that there is no gathering section 14 (see FIG. 3). In the second embodiment as well, each of the exhaust ports 13 is provided inside the cylinder head 10A in correspondence with each cylinder 11, as in the first embodiment, and the first end thereof is coupled to the combustion chamber 11A via the two exhaust gas valves 11C. However, the second end of each exhaust port 13 forms an exhaust outlet 13A provided on a side surface of the cylinder head 10A, and the exhaust gas that has flown down through each exhaust port 13 flows outside from the exhaust outlet 13A. These exhaust outlets 13A are coupled to a branch pipe of a not shown exhaust gas manifold.

The internal combustion engine 1 of the second embodiment comprises two or more purification devices 2, and each of the purification devices 2 is arranged at the corresponding one of the exhaust ports 13. As an example, each purification device 2 is arranged at the corresponding exhaust port 13 so that a portion of the case 21 is located inside the exhaust port 13, and the remaining portion protrudes outside from the corresponding one of the exhaust outlets 13A of the cylinder head 10A. Specifically, each purification device 2 covers the corresponding exhaust outlet 13A, and is arranged so that a portion of the purification device 2 protrudes from the corresponding exhaust port 13. Of course, arrangement of the purification device 2 is not limited to this. Each purification device 2 may be arranged so that the entire case 21 is located inside the exhaust port 13, and may be arranged away from the exhaust outlet 13A inside the exhaust port 13.

Thus, when the exhaust gas that has flown out of each combustion chamber 11A reaches the purification device 2, the exhaust gas enters the case 21 and is purified by the purification member 20, as in the first embodiment. Then, the purified exhaust gas flows outside the case 21, and further flows downstream.

In each purification device 2, as an example, the position of the purification member 20 inside the case 21 is adjusted so that the purification member 20 is located inside the internal combustion engine 1 (in other words, inside the main body 10), as in the first embodiment. Of course, the position of the purification member 20 inside the case 21 is not limited to this, and can be adjusted as appropriate.

(3) Configuration of Refrigerant Flow Path

In the second embodiment as well, the internal combustion engine 1 comprises a first refrigerant flow path 16 having a water jacket similar to that of the first embodiment, and is cooled by a coolant flowing down through a first refrigerant flow path 16 (see FIG. 3). However, the internal combustion engine 1 of the second embodiment cools the purification device 2 by a second refrigerant flow path 17 provided separately from the first refrigerant flow path 16.

The second refrigerant flow path 17 is configured to cool the purification device 2, and is arranged near a segment (hereinafter, a placement segment) of each exhaust port 13 where the purification device 2 is arranged. As an example, the second refrigerant flow path 17 is located on an outer side of each exhaust port 13, and is arranged to surround an outer peripheral surface of the placement segment. Specifically, the second refrigerant flow path 17 (in other words, the cooler) is arranged to face a portion of the case 21 adjacent to the purification member 20. Also, the second refrigerant flow path 17 is arranged so as to surround the purification member 20. Of course, arrangement of the second refrigerant flow path 17 is not limited to this. The second refrigerant flow path 17 may be arranged inside each exhaust port 13. Further, the second refrigerant flow path 17 may be arranged inside each exhaust port 13 so as to contact the case 21 of the purification device 2.

A refrigerant for cooling devices mounted on the vehicle other than the internal combustion engine 1 flows down through the second refrigerant flow path 17. As an example, the devices may include an air conditioner of the vehicle. Refrigerant gas of the air conditioner may be circulated through the second refrigerant flow path 17. In this case, the refrigerant gas of the air conditioner may be supplied from a flow path branched from a refrigerant flow path of the air conditioner.

A refrigerant inlet 17A and a refrigerant outlet 17B of the second refrigerant flow path 17 are provided on a side surface of the cylinder block 10B, as an example. For example, a refrigerant for the other devices flows in from the refrigerant inlet 17A by a not shown pump or the like, flows down through the second refrigerant flow path 17, and thereafter flows outside from refrigerant outlet 17B. As a result, the purification device 2 arranged in each exhaust port 13 is cooled.

(4) Modified Example

The internal combustion engine 1 of the second embodiment may be provided with the two or more exhaust ports 13 and the gathering section 14, as in the first embodiment. Similarly, the purification device 2 may be arranged at each exhaust port 13.

3. Effect (1) According to the above-described embodiments, since the purification device 2 is provided inside the internal combustion engine 1, a distance between the purification device 2 and the combustion chamber 11A becomes short. Thus, since the exhaust gas with higher temperature passes through the purification member 20, it becomes easier to increase the temperature of the purification member 20 at the time of starting the internal combustion engine 1, for example, without separately providing a heating device such as an electric heater. Accordingly, while deterioration of fuel efficiency or increase in costs are inhibited, and weight reduction of the vehicle, reduction in number of components, or reduction of $CO_2$ discharge amount during manufacturing are achieved, time to reach the temperature at which the purification member 20 becomes active can be reduced.

Due to exposure of the purification member 20 to high temperature exhaust gas, sintering is generated in which catalyst metals in the purification member 20 aggregate, thereby reducing the area of contact between the exhaust gas and the catalyst metals. As a result, purification performance by the purification member 20 may be reduced. In contrast, according to the above-described embodiments, the purification device 2 is cooled by the cooler 15B or the second refrigerant flow path 17. Thus, reduction in purification performance of the purification device 2 can be inhibited.

The internal combustion engine 1 contains a lot of metal materials and has a large heat capacity as a whole. The temperature thereof is less likely to decrease even after the operation stops. Thus, even after the internal combustion engine 1 is stopped, cooling of the purification member 20 is inhibited. As a result, time to reach the temperature at which the purification member 20 becomes activate at the time of restarting the internal combustion engine 1 can be shortened.

(2) In the first embodiment, the purification device 2 is arranged in the gathering section 14. Thus, the exhaust gas that has flown out of each combustion chamber 11A can be efficiently purified.

(3) In the second embodiment, the purification device 2 is arranged at each exhaust port 13. Thus, even if the gathering section 14 is not provided inside the internal combustion engine 1, the purification device 2 can be arranged inside the internal combustion engine 1.

(4) In the first embodiment, the purification device 2 is cooled by the coolant for cooling the internal combustion engine 1. Thus, with the conventionally used configuration, the purification device 2 provided inside the internal combustion engine 1 can be cooled. Accordingly, it is possible to ensure reliability and reduce complexity due to addition of the cooler. As a result, the manufacturing cost can be reduced, or the $CO_2$ discharge amount during the manufacturing can be reduced.

(5) In the second embodiment, the purification device 2 is cooled using the refrigerant for cooling the devices mounted on the vehicle other than the internal combustion engine 1. Thus, the purification device 2 can be efficiently cooled.

(6) In the first and second embodiments, the cooler is arranged to face the portion of the case 21 adjacent to the purification member 20. Thus, it is possible to appropriately cool the purification member 20.

4. Other Embodiments (1) In the first and second embodiments, the purification device 2 is arranged at the exhaust port 13 or in the gathering section 14 provided in the cylinder head 10A of the internal combustion engine 1. However, two or more flow paths (in other words, first flow paths) each coupled to the corresponding one of the exhaust ports 13, and an exhaust flow path (in other words, a second flow path) formed by combining these first flow paths into one may be provided in the cylinder block 10B of the internal combustion engine 1. Moreover, the cylinder block 10B may be provided with an outlet for the second flow path. As in the first embodiment, the purification device 2 may be arranged in the second flow path, or the purification device 2 may be arranged in each of the first flow paths.

The cylinder block 10B may be provided with two or more first flow paths without a gathering section, and an outlet of each of the first flow paths may be provided in the cylinder block 10B. Then, as in the second embodiment, the purification device 2 may be arranged in each of the first flow paths.

(2) In the internal combustion engine 1 of the first embodiment, a first refrigerant flow path for cooling the internal combustion engine 1 and a second cooling flow path for cooling the purification device 2 may be provided, as in the second embodiment. Then, by flowing the refrigerant for cooling the devices other than the internal combustion engine 1 down the second cooling flow path, the purification device 2 may be cooled, as in the second embodiment.

In the internal combustion engine 1 of the second embodiment, the refrigerant flow path for flowing down the coolant for the internal combustion engine 1 may be arranged near each purification device 2, and each purification device 2 may be cooled by the coolant flowing down the refrigerant flow path, as in the first embodiment.

In the internal combustion engine 1 of the first and second embodiments, the purification device 2 may be cooled not by the refrigerant used for cooling the devices other than the purification device 2 but by using a refrigerant provided exclusively for cooling the purification device 2.

(3) Two or more functions achieved by one element of the above-described embodiments may be achieved by two or more elements. One function achieved by one element may be achieved by two or more elements. Two or more functions achieved by two or more elements may be achieved by one element. One function achieved by two or more elements may be achieved by one element. Part of the configurations in the above-described embodiments may be omitted. At least part of the configurations in one of the above-described embodiments may be added to or replaced with the configuration in another one of the above-described embodiments.

7. Technical Idea Disclosed in Present Specification

Item 1

An internal combustion engine of a vehicle, comprising:
at least one combustion chamber;

a main body including therein the at least one combustion chamber and an exhaust flow path configured to allow exhaust gas flowing out of the at least one combustion chamber to flow down;

at least one purification device arranged in the exhaust flow path of the main body; and a cooler configured to cool the at least one purification device, each of the at least one purification device including:

a purification member configured to purify the exhaust gas; and a case that stores the purification member.

Item 2

The internal combustion engine according to Item 1, wherein two or more combustion chambers are provided as the at least one combustion chamber, one purification device is provided as the at least one purification device, the exhaust flow path includes two or more first flow paths and a second flow path, each of the first flow paths being coupled to a corresponding one of the combustion chambers, and the second flow path being formed by combining the first flow paths into one, and the purification device is arranged in the second flow path.

Item 3

The internal combustion engine according to Item 1, wherein two or more combustion chambers are provided as the at least one combustion chamber, two or more purification devices are provided as the at least one purification device, the exhaust flow path includes two or more first flow paths, each of which extending from a corresponding one of the combustion chambers, and each of the purification devices is arranged in a corresponding one of the first flow paths.

Item 4

The internal combustion engine according to any one of Items 1 to 3, wherein the cooler has a flow path for a refrigerant for cooling the internal combustion engine.

Item 5

The internal combustion engine according to any one of Items 1 to 3, wherein the cooler has a flow path for a refrigerant for cooling devices mounted on the vehicle other than the internal combustion engine.

Item 6

The internal combustion engine according to any one of Items 1 to 5, wherein the cooler is arranged to face a portion of the case adjacent to the purification member.

Item 7

A purification device provided in an internal combustion engine according to any one of Items 1 to 6, the purification device comprising:

a purification member configured to purify the exhaust gas; and a case that stores the purification member.

8. Correspondence Relationship Between Words

The exhaust ports 13 correspond to one example of the first flow paths. The gathering section 14 corresponds to one example of the second flow path.

What is claimed is:

1. A wheeled land vehicle comprising an internal combustion engine, the internal combustion engine comprising:

at least one combustion chamber;

a main body including therein the at least one combustion chamber and an exhaust flow path configured to allow passage of exhaust gas flowing out of the at least one combustion chamber;

at least one purification device arranged in the exhaust flow path of the main body; and a cooler located inside the main body and configured to cool the at least one purification device, wherein:

each purification device of the at least one purification device includes:

a purification member configured to purify the exhaust gas; and a case containing the purification member, the exhaust flow path has at least one exhaust outlet that is configured to allow the exhaust gas to flow out of the main body, and for each purification device of the at least one purification device, the purification device is arranged in the exhaust flow path with a portion of the case protruding from a corresponding exhaust outlet of the at least one exhaust outlet to outside of the main body and of the internal combustion engine.

2. The wheeled land vehicle according to claim 1, wherein:

the at least one combustion chamber comprises two or more combustion chambers, the at least one purification device embodies a single purification device, the exhaust flow path includes two or more first flow paths and a second flow path, each of the two or more first flow paths being coupled to a corresponding one of the two or more combustion chambers, and the second flow path being formed by combining the two or more first flow paths into a single second flow path, and the single purification device is arranged in the second flow path.

3. The wheeled land vehicle according to claim 1, wherein:

the at least one combustion chamber comprises two or more combustion chambers, the at least one purification device comprises two or more purification devices, the exhaust flow path includes two or more first flow paths, each first flow path extending from a corresponding one of the two or more combustion chambers, and each of the two or more purification devices is arranged in a corresponding one of the two or more first flow paths.

4. The wheeled land vehicle according to claim 1, wherein for each purification device of the at least one purification device, the purification member is located inside the main body.

5. The wheeled land vehicle according to claim 1, wherein the cooler has a flow path for a refrigerant for cooling the internal combustion engine.

6. The wheeled land vehicle according to claim 1, wherein the cooler has a flow path for a refrigerant for cooling an air conditioner mounted on the vehicle.

7. The wheeled land vehicle according to claim 1, wherein for each purification device of the at least one purification device, the cooler is arranged to face a portion of the case adjacent to the purification member.

8. A wheeled land vehicle comprising an internal combustion engine, the internal combustion engine comprising:

at least one combustion chamber;

a main body including therein the at least one combustion chamber and an exhaust flow path configured to allow passage of exhaust gas flowing out of the at least one combustion chamber;

at least one purification device arranged in the exhaust flow path of the main body; and a cooler located inside the main body and configured to cool the at least one purification device, wherein:

each purification device of the at least one purification device includes:

a purification member configured to purify the exhaust gas; and a case containing the purification member, and the cooler has a flow path for a refrigerant for cooling a device mounted on the vehicle, the device mounted on the vehicle being a device other than the internal combustion engine.

9. The wheeled land vehicle according to claim 8, wherein:

the at least one combustion chamber comprises two or more combustion chambers, the at least one purification device embodies a single purification device, the exhaust flow path includes two or more first flow paths and a second flow path, each of the two or more first flow paths being coupled to a corresponding one of the two or more combustion chambers, and the second flow path being formed by combining the two or more first flow paths into a single second flow path, and the single purification device is arranged in the second flow path.

10. The wheeled land vehicle according to claim 8, wherein:

the at least one combustion chamber comprises two or more combustion chambers, the at least one purification device comprises two or more purification devices, the exhaust flow path includes two or more first flow paths, each first flow path extending from a corresponding one of the two or more combustion chambers, and each of the two or more purification devices is arranged in a corresponding one of the two or more first flow paths.

11. The wheeled land vehicle according to claim 8, wherein:

the exhaust flow path has at least one exhaust outlet that is configured to allow the exhaust gas to flow out of the main body, and for each purification device of the at least one purification device, the purification device is arranged in the exhaust flow path with a portion of the case protruding from a corresponding exhaust outlet of the at least one exhaust outlet to outside of the main body and of the internal combustion engine.

12. The wheeled land vehicle according to claim 11, wherein for each purification device of the at least one purification device, the purification member is located inside the main body.

13. The wheeled land vehicle according to claim 8, wherein for each purification device of the at least one purification device, the purification member is located inside the main body.

14. The wheeled land vehicle according to claim 8, wherein the device mounted on the vehicle is an air conditioner of the vehicle.

* * * * *